United States Patent [19]

Bates et al.

[11] 3,980,919

[45] Sept. 14, 1976

[54] RECTANGULAR BEAM LAMINAR FLOW ELECTRON GUN

[75] Inventors: David J. Bates, Los Altos, Calif.; Aris Silzars, Portland, Oreg.; Lester A. Roberts, Palo Alto, Calif.

[73] Assignee: Watkins-Johnson Company, Palo Alto, Calif.

[22] Filed: Dec. 20, 1974

[21] Appl. No.: 535,098

[52] U.S. Cl. ..... 313/453; 315/15

[51] Int. Cl.[2] ..... H01J 29/46

[58] Field of Search ..... 315/14, 15, 16; 313/410, 453

[56] References Cited

UNITED STATES PATENTS

| | | | |
|---|---|---|---|
| 2,817,033 | 12/1957 | Brewer | 313/453 |
| 2,866,126 | 12/1958 | Skellett | 313/453 |
| 2,999,182 | 9/1961 | Field | 313/453 |
| 3,202,864 | 8/1965 | Crowell | 313/410 |
| 3,740,607 | 6/1973 | Silzars et al. | 313/453 |
| 3,881,136 | 4/1975 | Scheele | 313/453 |

*Primary Examiner*—Maynard R. Wilbur
*Assistant Examiner*—T. M. Blum

[57] ABSTRACT

A laminar flow electron gun employing a narrow, elongated cathode for forming a rectangular beam and a plurality of electrodes having narrow, elongated apertures cooperating with said cathode to draw electrons from said cathode and operate on the electrons to focus the rectangular beam onto a target by providing a parallel flow region adjacent said cathode, followed by a divergent flow region, in turn, followed by a convergent flow or focusing region.

6 Claims, 9 Drawing Figures

RECTANGULAR BEAM LAMINAR FLOW ELECTRON GUN

BACKGROUND OF THE INVENTION

This invention relates generally to an electron gun and more particularly to an electron gun for projecting a laminar flow rectangular beam in the form of a sheet of electrons.

Rectangular or sheet beam electron guns of the prior art have utilized a cathode forming a circular electron beam which is then shaped by using intercepting apertures and/or two-dimensional electrostatic or magnetic lenses to form the sheet beam. This technique can be used only with relatively low current density beams and has a relatively low efficiency for beam transmission in view of the interception of the beam by the apertures. Another type of sheet beam gun of the prior art has utilized rectangular electrode structure which forms a beam which is magnetically or electrostatically focused during or after the beam leaves the accelerating portion of the gun. Neither of the techniques described above provides a high efficiency laminar flow sheet beam which is sharply focused on a distant target where no focusing or confining electrostatic or magnetic field is required after the beam leaves the gun.

OBJECTS AND SUMMARY OF THE INVENTION

It is a general object of the present invention to provide an improved electron gun for forming a rectangular beam.

It is another object of the present invention to provide a rectangular beam electron gun producing a high current density beam which does not require focusing in the region between the gun and target.

It is a further object of the present invention to provide a rectangular beam electron gun which focuses the beam on a target with minimal variations in cross-sectional dimensions as the beam traverses the gun region.

It is a further object of the present invention to provide a rectangular beam electron gun with highly uniform current density distribution across and along the beam.

It is a further object of the present invention to provide a relatively simple, compact, rectangular beam electron gun structure.

It is still another object of the present invention to provide a rectangular beam electron gun in which the beam can be density modulated with a control electrode while maintaining a relatively small and constant line width of the beam.

It is another object of the present invention to provide a rectangular beam electron gun which has high current efficiency.

It is another object of the present invention to provide a rectangular beam electron gun useful over a wide range of exit sizes, beam currents and focal lengths.

It is another object of the present invention to provide a rectangular beam electron gun having a beam current control electrode.

The foregoing and other objects of the invention are achieved by an electron gun including a narrow, elongated, essentially rectangular cathode providing an elongated source of electrons, a control electrode having a narrow, elongated, essentially rectangular aperture surrounding said cathode and having a surface providing substantial continuation of the cathode surface, an anode spaced from the cathode surface and control electrode and serving to provide a field at said cathode which accelerates the electrons from the surface of the cathode all at substantially the same velocity and substantially perpendicular to the surface of the cathode to provide a uniform flow of electrons towards said anode and additional electrodes for receiving, further accelerating, and projecting and focusing the beam on a target across the narrow dimension of the beam while continuously maintaining substantially parallel flow across the wide dimension of the beam.

DESCRIPTION OF PREFERRED EMBODIMENTS

Figure 1:
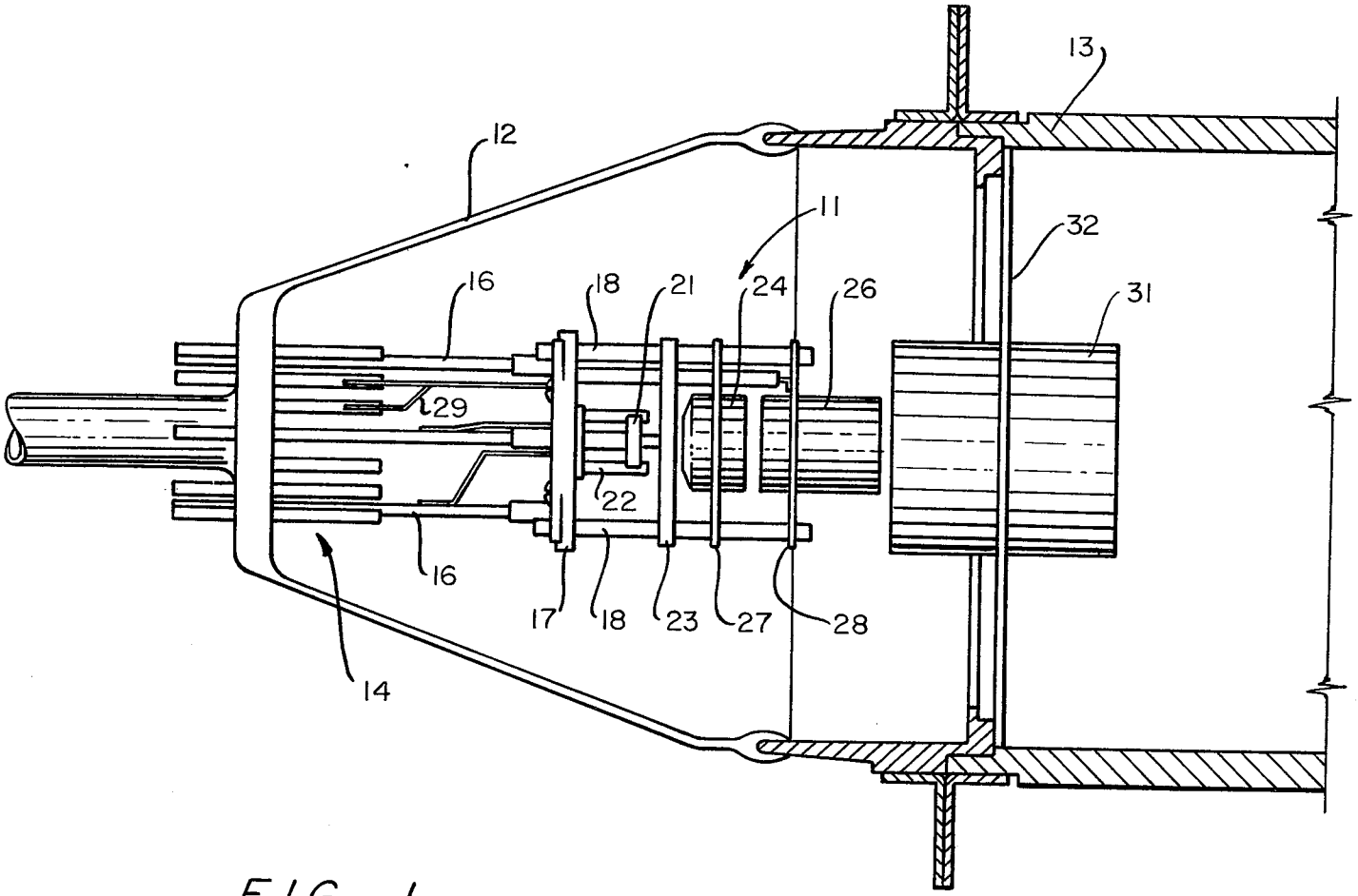
FIG. 1 is a side elevational view of the end of an electron beam device showing an electron gun in accordance with the invention.

FIGS 1–4 show an electron gun designated generally by the reference numeral 11 mounted at the glass end 12 of envelope 13 such as the envelope of an electron bombarded semiconductor amplifier, cathode ray tube or similar device. The gun structure is supported from the end of the envelope by a plurality of pins 14 extending into the evacuated envelope. More particularly, the electron gun is supported by the elongated pins 16 which extend inwardly and engage a support plate 17 to which are affixed a plurality of spaced ceramic rods 18 for supporting the various gun electrodes. Indirectly heated cathode 21 is supported from the plate 17 by means of spaced metal rods 22. Control electrode 23 is supported by ceramic rods 18 as are the anode 24 and focusing electrode 26. The anode 24 and focusing electrode 26 are supported from the ceramic rods 18 by flanges 27 and 28. The pins 14 are electrically connected to the various electrodes by means of conductive straps 29. An additional electrode 31 is supported from the envelope 13 by flange 32. The additional electrode is maintained at the same potential as the envelope.

Figure 3:
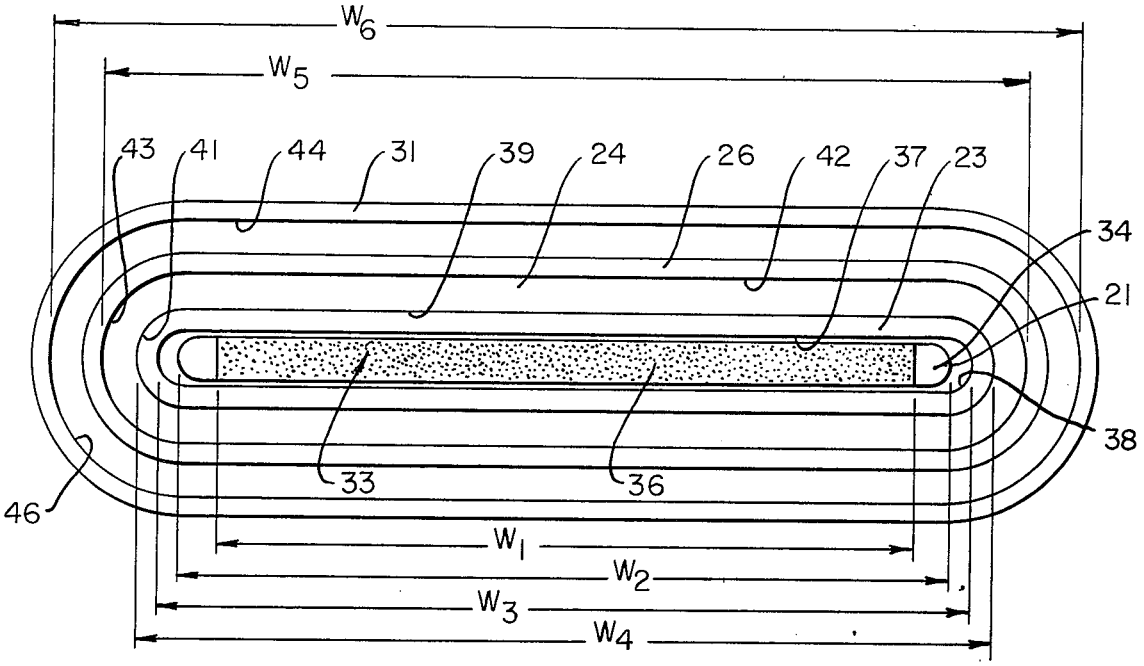
FIG. 3 is an end view of the electron gun shown in FIG. 2 taken generally along the lines 3—3.

Referring more specifically to FIG. 3, it is seen that the cathode 21 includes a narrow, elongated rectangular surface 33 having rounded or semi-circular ends 34. The cathode surface is coated with an electron emitting layer 36 over substantially its entire length. The control electrode 23 includes a narrow, elongated rectangular aperture 37 having rounded ends 38 adjacent to and cooperating with the rounded ends of the cathode surface. Similarly, the anode 24 includes a narrow, elongated rectangular aperture 39 having rounded ends 41. The focusing electrode 26 includes an elongated rectangular central portion 42 with rounded ends 43. The additional electrode 31 includes an elongated central portion 44 with rounded ends 46.

Figure 2:
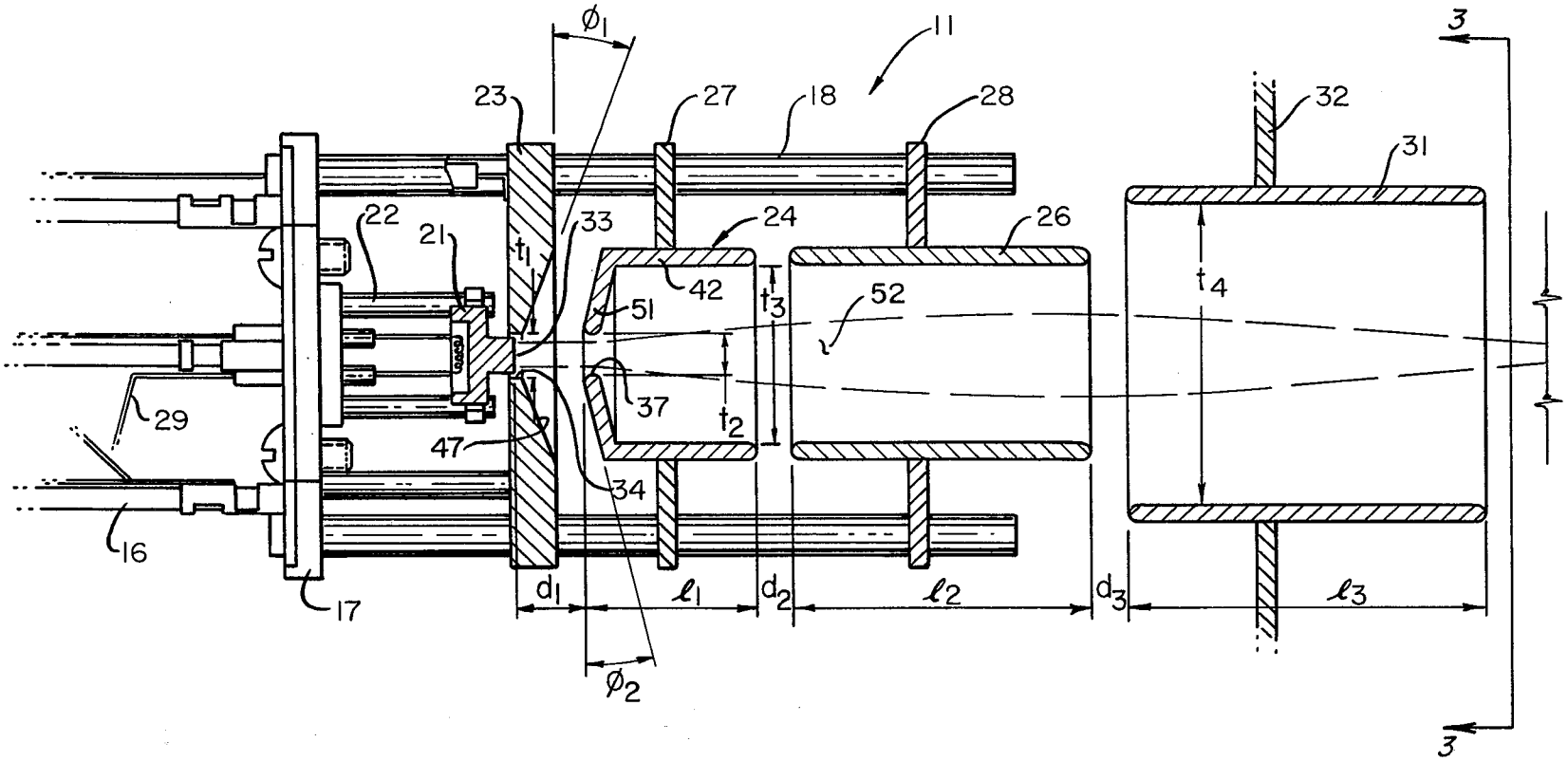
FIG. 2 is an enlarged sectional view of the electron gun shown in FIG. 1 with the electron beam envelope.

Referring specifically to FIG. 2, which is a sectional view showing the narrow dimension of the beam, it is seen that the control electrode aperture 37 is closely adjacent the side of the cathode surface 33. The surface 47 of the control electrode provides substantially a continuation of the surface of the cathode. This continuation not only extends away from the sides of the cathode but also at the rounded ends of the cathode.

Figure 5:
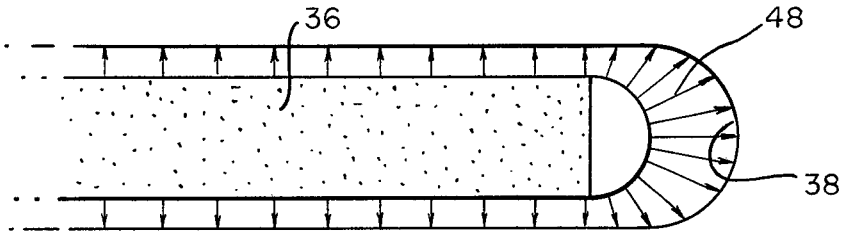
FIG. 5 is an enlarged view of the end of the cathode and the control electrode showing electric field lines.

Referring particularly to FIG. 5, the electric field lines 48 are shown at one end of the cathode surface. It is noted that they are substantially uniform adjacent the surface 36. The configuration and spacing of the rounded ends 38 of the control electrode aperture is selected so that the electric fields between the cathode and control electrode remain substantially uniform up to and beyond the emitting layer whereby the electrons leaving the surface are not subjected to fringing fields so that the electron beam flow is essentially parallel across the wide dimension of the beam.

Figure 4:
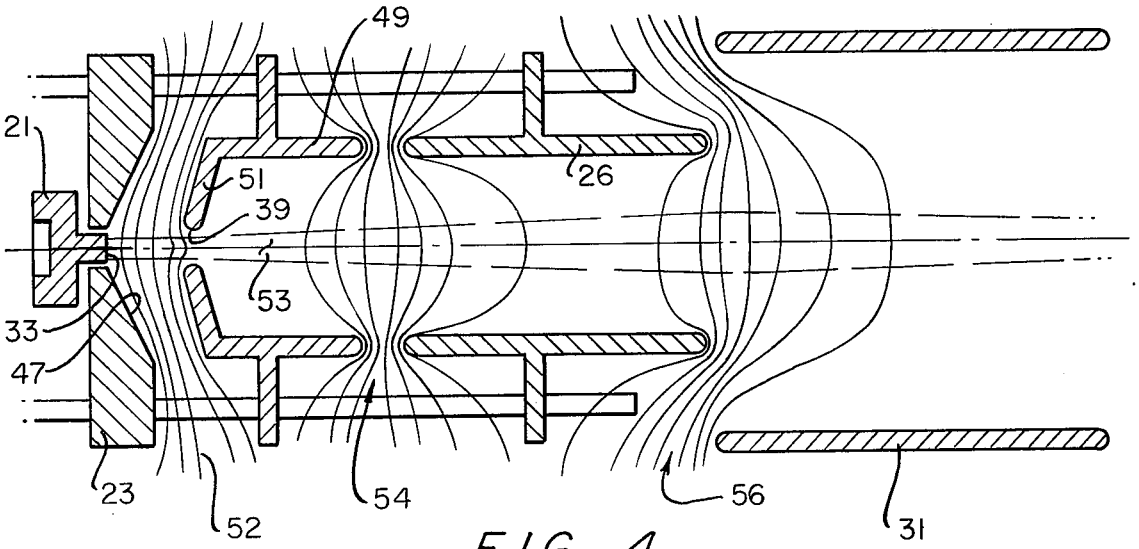
FIG. 4 is a sectional view as in FIG. 2 showing the equi-potential lines and electron beam envelope.

The anode includes a box-like portion 49 whose walls extend longitudinally of the gun for a predetermined length and which cooperate with the beam as will be presently described. The walls are rounded at the ends. The front end of the anode includes a lip or rim 51 which extends inwardly to define the elongated aperture 39 with its rounded ends 41. The length of the lips and their angle $\phi_2$ relative to the angle $\phi_1$ of the control electrode surface 47 is selected, as will be presently described, whereby to provide a substantially uniform axial electric field over the entire surface of the cathode. Referring to FIG. 4, the equipotential lines of the electric field between the anode and cathode and control electrode are shown at 52. It is noted that the electric field at the surface of the cathode is substantially uniform and axial. The field at the anode aperture 39 is slightly diverging to spread the beam 53 as shown. As a consequence, electrons emitted by the cathode are emitted substantially perpendicular to the cathode surface and parallel to one another, and then start to diverge. At the ends, the fields are selected to maintain the electron flow substantially parallel across the wide dimension of the beam.

Figure 6:
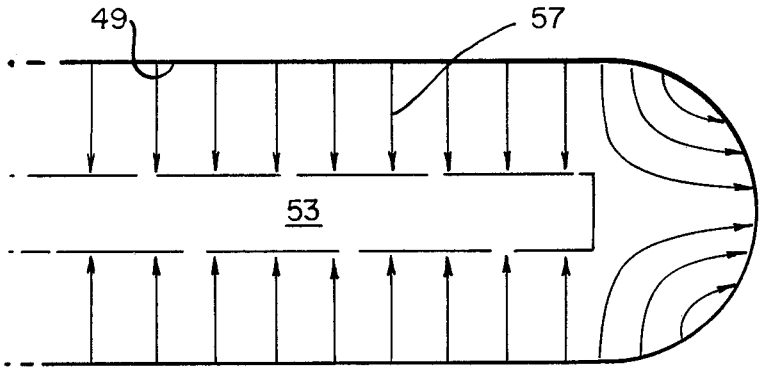
FIG. 6 is an enlarged view of the edge of the electron beam at the first anode showing the transverse electric field which defocuses the beam in the narrow transverse dimension.

The other end of the anode 24 cooperates with the focusing and accelerating electrode 26 to form a convergent lens, such as shown by the equipotential lines in FIG. 4. This lens begins to converge the beam 53 as it travels into the inner region of the elongated focusing electrode 26. The electrode 31 cooperates with the accelerating and focusing electrode 26 to provide an additional convergent lens shown by the equipotential lines 56. This lens further converges and focuses the beam onto the target. Once the electron beam leaves the final electrode 31, it is in a field-free region and no longer under any focusing influences. There are, however, effects which tend to spread or defocus the beam such as space charge repulsion, transverse thermal velocities and transverse velocities due to aberrations and/or gun asymmetries. Preferably, the beam thickness is increased by the divergent lens formed between the anode and cathode so that it can be subsequently focused on the target by the convergent lenses. The curvature and spacing of the sides of the box-like electrodes is selected to provide substantially uniform fields at the beam ends with decreasing fields at the beam edge such as shown in FIG. 6 by the vectors 57 between the beam 53 and the portion 49.

Thus, the design of the sheet beam or rectangular electron gun includes three regions which act upon the electrons: (1) a beam forming or parallel flow region between the cathode surface, control electrode and anode where the established field, shown by the equipotential lines 52 between the anode and cathode and control electrode draws the electrons from the cathode and causes them to flow as a laminar beam and which may slightly diverge the beam to increase its thickness while maintaining substantially uniform width; (2) a divergent flow, and electrostatic focus region which includes the convergent lenses formed between anode 24 and accelerating electrode 26 and between accelerating electrode 26 and additional electrode 31 which increases the convergence and focuses the beam; and, (3) a field-free region to the target where the electrons travel initially in a converging laminar flow and are travelling essentially parallel as they strike the target. The basic concept of the invention is to shape the electric fields in the gun so as to initially produce a beam having a uniform current density and parallel flow from the cathode, then expand the beam across its narrow dimension by means of a divergent electrostatic lens or lenses and finally to reconverge the beam so that it is focused on its narrow dimension on the screen or target. In its wide dimension, the curvature and spacing of the electrodes is such as to provide parallel flow of the electrons whereby to maintain the wide dimension substantially constant along the beam. It has been found that the coated length, $W_1$, of the coated cathode surface 36 can be varied appreciably, in order to vary the beam width without the necessity of designing and building a new gun.

Lens aberrations are minimized by using long focal length lenses and utilizing only the central portion of these lenses. The effects of asymmetries are minimized since no small apertures are used either for the cathode current control electrode or for the limiting apertures. Since the initial beam trajectories are parallel and perpendicular to the cathode plane, the virtual image of the cathode, which serves as the object to be focused on the target, occurs at an extremely large distance behind the cathode. This virtual image is then used to produce a well focused beam at the target in the following two steps, described above. A very weak divergent anode lens spreads the beam slightly while introducing a minimum lens aberration and then the expanded beam is reconverged so as to form an image of the cathode on the screen. Under space charge limited conditions, parallel flow will occur at the target. Under thermally limited conditions, the variation in average beam diameter at the target will be small as a function of distance in the region near the target so that pseudo parallel flow will result at the target. No limiting apertures are needed since essentially the full beam is used. Except for the effect of thermal velocities, the current density at each point is essentially uniform across the beam and throughout the entire beam length.

Figure 9:
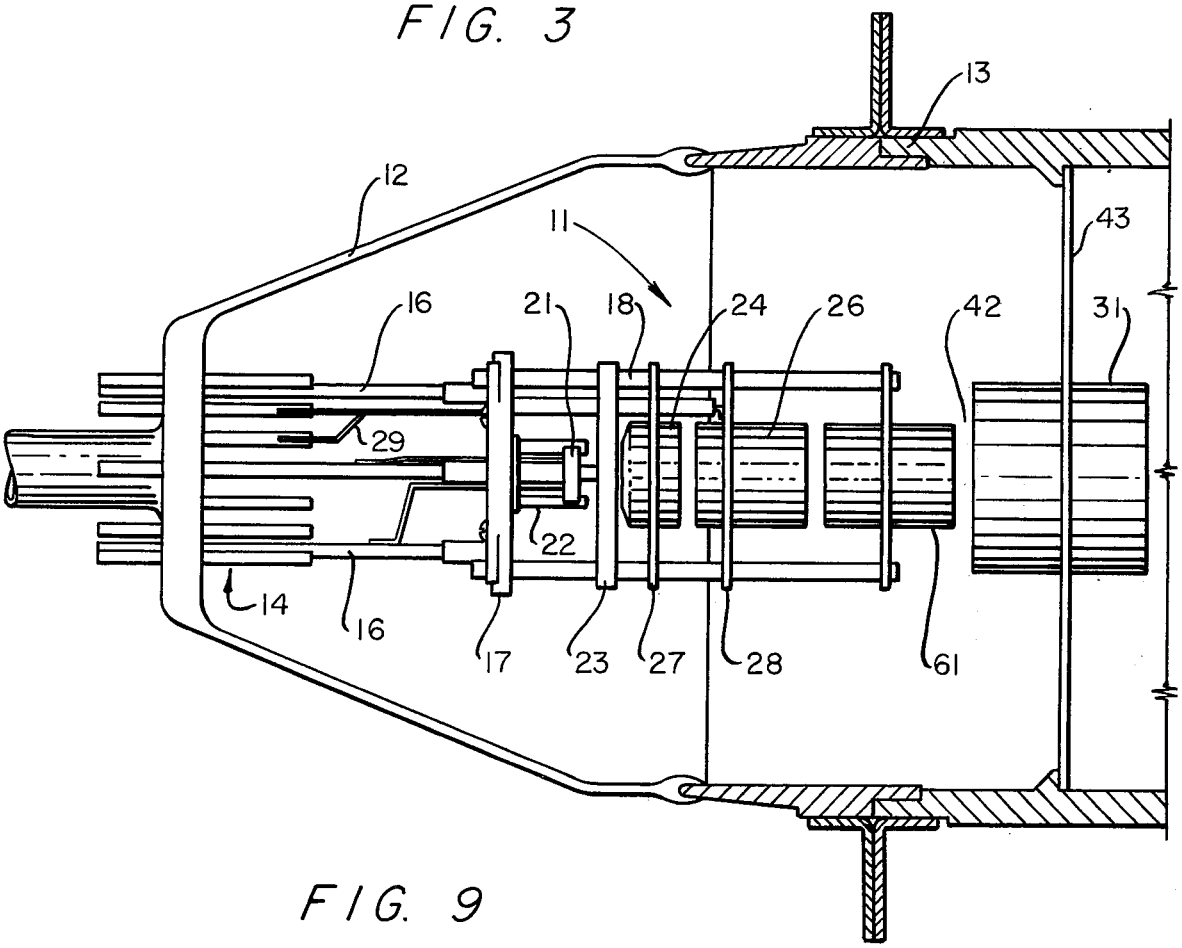
FIG. 9 is a side elevational view of the electron gun of the type shown in FIG. 1 with an additional focusing electrode.

A gun was constructed with dimensions, angles and applied voltages, references in FIGS. 2 and 3 with an additional electrode as shown in FIG. 9, as follows:

| | |
|---|---|
| $\phi_1 = 30°$ | $l_1 = .185''$ |
| $\phi_2 = 18°$ | $l_2 = .370''$ |
| $t_1 = .034''$ | $l_3 = .370''$ |
| $t_2 = .160''$ | $W_1 = .650''$ |
| $t_3 = .400''$ | $W_2 = .736''$ |
| $t_4 = .400''$ | $W_3 = .760''$ |
| $d_1 = .055''$ | $W_4 = .886''$ |
| $d_2 = .074''$ | $W_5 = 1.126''$ |
| $d_3 = .074''$ | $W_6 = 1.126''$ |

Figure 7:
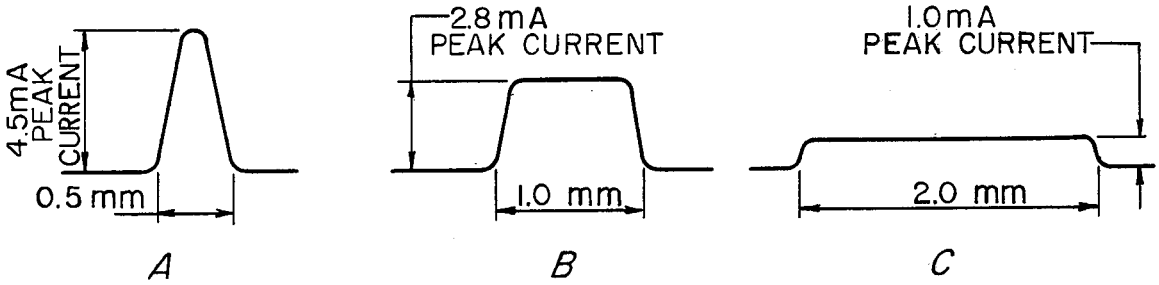
FIGS. 7A–C show the beam thickness at the target for different beam focusing conditions showing how beam width and current density can be varied.

The gun was operated with the cathode 21 and control electrode 23 at 0 volts, and the anode 24 at 750 volts, the focusing electrode 26 at 3700 volts, and the additional electrodes 31 and 61 at 2700 volts and 12,500 volts respectively. The guns formed a spot on a target spaced 8 inches from the cathode as shown in FIGS. 7A, 7B and 7C for different beam currents.

Figure 8:
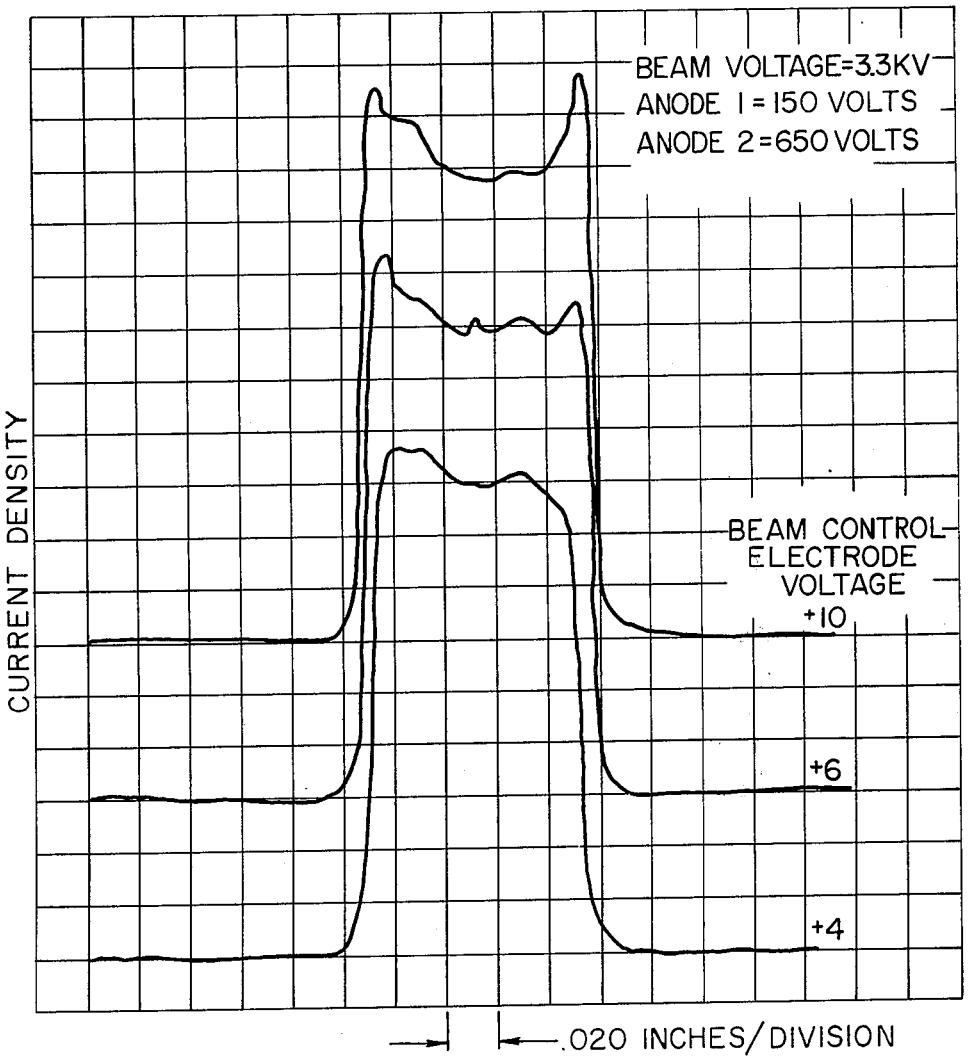
FIG. 8 shows the beam current density as a function of position across the electron beam as it exits from the sheet beam electron gun for different control electrode voltages.

In FIG. 8 there is shown the beam current as a function of position in the beam as it exits from a gun similar to the type specified above with $e_1 = 150$ volts, $e_2 = 650$ volts and $e_3 = 3300$ volts for control voltages, $e_g = 4$, 6 and 10 volts.

In the embodiment described there are three electrostatic lenses, the first of which diverges the beam and the following two which provide convergence towards the screen. The electron gun does not allow independent adjustment of exit beam thickness and beam convergence angle. In the gun design shown in FIG. 9, there is provided an additional electrode 61 between the electrodes 26 and 31 which permits further focusing of the beam. The additional lens allows independent control of both exit beam thickness and beam convergence angle by application of voltage thereto. Thus, after the gun has been designed and fabricated into a finished tube, the exit beam thickness and convergence angle can be adjusted independently by selecting the voltages on the electrodes 24, 26 and 31, 61. In the design described above, voltage changes as well as geometry changes are necessary to achieve both variations in beam width and convergence. Therefore, the design of FIG. 9 provides freedom in that the external voltages can be adjusted to change the geometry of the various electrostatic fields and thereby provide a convenient way of both changing beam thickness and focusing the beam at the target. It also permits a wider latitude in the size and geometry of the various electrodes.

One embodiment of the present invention design allows essentially complete freedom to select the beam thickness and convergence angle in the gun region and, therefore, to achieve essentially any desired line thickness of the beam at the target. In summary, there has been provided an improved sheet rectangular or sheet beam electron gun which provides a rectangular beam sharply focused upon a target which can be modulated by a control electrode with minimum effect on beam size and which operates with high efficiency.

We claim:

1. An electron gun for providing a rectangular laminar flow beam comprising a wide cathode having an elongated, narrow electron emitting surface, a control electrode having a narrow, elongated aperture surrounding and substantially equally spaced from all sides of said cathode, said control electrode having a surface cooperating with said cathode surface to provide a surface which is substantially a continuation of the surface of the cathode, an anode having a narrow, elongated aperture which is longer than that of the control electrode, said anode being spaced in the direction of the beam from said cathode and control electrodes and being at a more positive potential than said cathode and control electrode to cooperate therewith to accelerate electrons at said cathode all at substantially the same velocity to provide a substantially uniform parallel laminar flow of electrons from the electron emitting surface in a rectangular beam flowing towards said anode, an additional electrode with a narrow, elongated aperture which is larger than that of the anode, cooperating with said anode and at a more positive potential for receiving and further accelerating said rectangular laminar flow beam and also serving to cooperate with said anode to provide an electrostatic lens for focusing said rectangular laminar flow beam across its narrow dimension, said electrodes cooperating with the rectangular beam to maintain substantially parallel flow in the wide dimension of the rectangular beam, and means cooperating with said electrode further focusing said beam across its narrow dimension to focus the beam upon a target.

2. An electron gun as in claim 1 wherein said means cooperating with said electrode comprises an additional electrode having an elongated aperture.

3. An electron gun as in claim 1 wherein said anode comprises a box-like portion with spaced side and rounded end walls extending longitudinally of the gun with a lip extending inwardly from the side and end walls to define said narrow elongated aperture.

4. An electron gun as in claim 2 wherein said additional electrode includes a box-like structure with spaced side walls and rounded end walls extending longitudinally of the gun.

5. An electron gun as in claim 1 wherein said cathode surface is coated with electron emitting material.

6. An electron gun as in claim 5 wherein said surface is only coated over a predetermined portion of its width to control the electron beam width.

* * * * *